United States Patent [19]

Kearney

[11] 4,283,999

[45] Aug. 18, 1981

[54] PAINT SPRAY BOOTH WITH WATER CURTAIN

[75] Inventor: Thomas J. Kearney, Malvern Wells, England

[73] Assignee: Champion Spark Plug Company, Toledo, Ohio

[21] Appl. No.: 128,249

[22] Filed: Mar. 7, 1980

[30] Foreign Application Priority Data

Mar. 9, 1979 [GB] United Kingdom ..... 08386/79

[51] Int. Cl.[3] ..... F23J 11/00

[52] U.S. Cl. ..... 98/115 SB; 55/228; 55/241; 55/257 PV; 118/326; 118/DIG. 7; 261/112; 261/DIG. 44

[58] Field of Search ..... 55/228, 257 PV, 240, 55/241, 89, 93–95, 85; 98/115 SB; 261/112, 119 R, DIG. 44; 118/326, DIG. 7

[56] References Cited

U.S. PATENT DOCUMENTS

| | | | |
|---|---|---|---|
| 1,073,622 | 9/1913 | Murray et al. | 55/95 |
| 2,132,826 | 10/1938 | Ludwig | 98/115 SB |
| 3,018,847 | 1/1962 | Stanley | 261/112 |
| 3,789,586 | 2/1974 | Arnold et al. | 55/228 |
| 3,981,694 | 9/1976 | Hultgren et al. | 98/115 SB |
| 4,096,066 | 1/1978 | Kearney | 98/115 SB |

FOREIGN PATENT DOCUMENTS

| | | |
|---|---|---|
| 785498 | 10/1957 | United Kingdom . |
| 1283202 | 7/1972 | United Kingdom . |

*Primary Examiner*—Ronald C. Capossela
*Attorney, Agent, or Firm*—Robert F. O'Connell

[57] ABSTRACT

A paint spraying booth has a back wall over which a water curtain flows to collect sprayed paint, a tank to receive the water curtain, vertical entrainment ducts disposed above the rear part of the tank, means for generating a flow of air through said ducts to lift water from the tank for the formation of the water curtain, a vertically-disposed wall separating the front and rear parts of the tank and having one or more transfer openings below the water surface, and baffle plates in the front part of the tank causing paint-laden water from the curtain to flow to a remote zone before returning to the transfer opening in order to minimize the quantity of paint passing into the rear part of the tank. A surface-removal device, preferably with a venturi unit, is arranged in front of the transfer opening to remove floating paint and pass it back to the baffled region for further dispersal.

7 Claims, 3 Drawing Figures

PAINT SPRAY BOOTH WITH WATER CURTAIN

Figure 1:
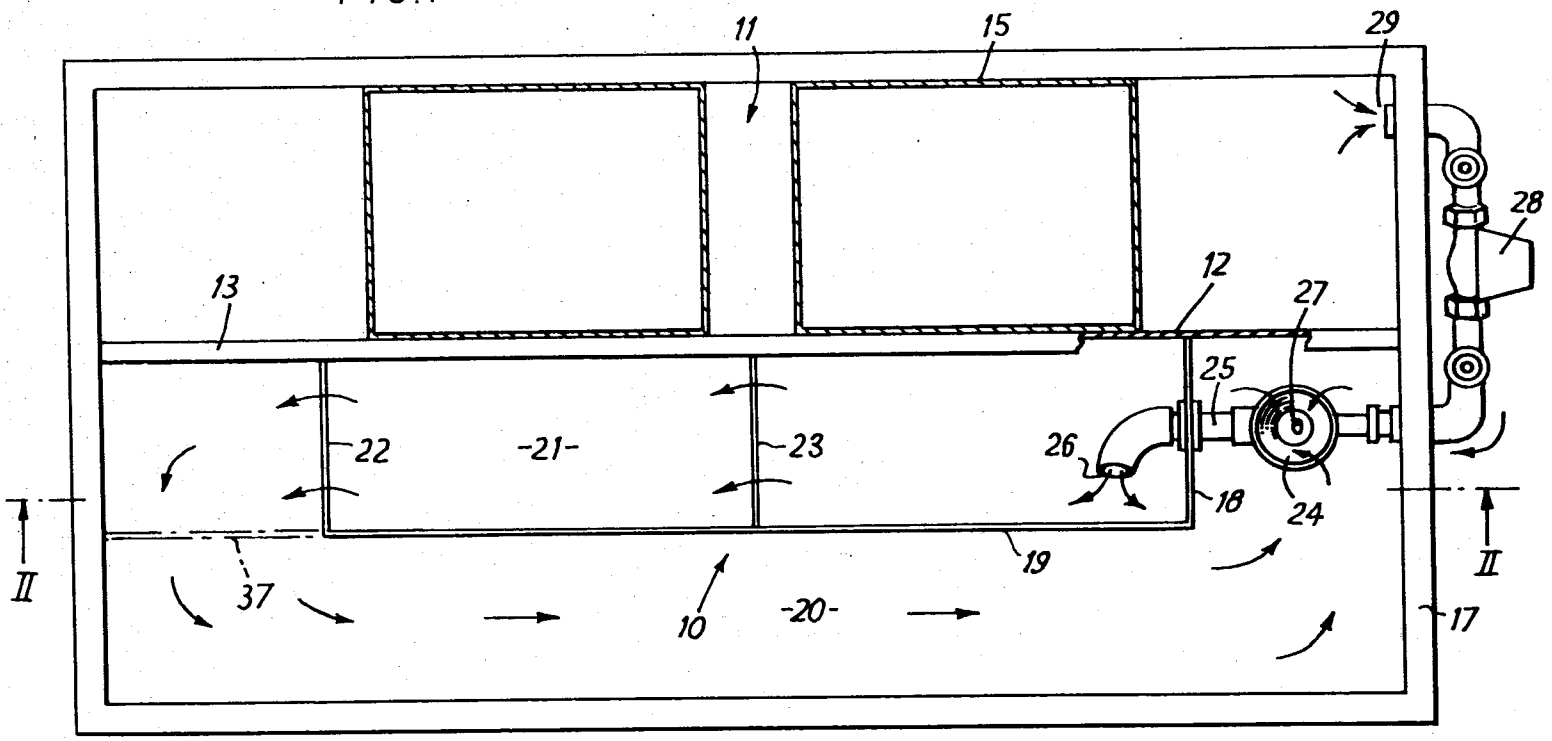

The present invention relates to a paint spray booth of the type in which a water curtain falling over a back wall of the booth into a tank is formed by water entrained from the water surface in a rear part of the tank by a flow of air through vertical entrainment ducts, the said surface in the rear part of the tank being divided by a surface baffle from the water surface in a front part of the tank into which the curtain falls.

A booth of this type is described in U.K. Pat. No. 1,283,202. The surface baffle prevents paint floating on the surface of the front part reaching the rear part of the tank but in the booth there described there is a continuous circulation of water from the front to the rear part under the full width of the surface baffle, which results in transfer of paint in suspension to the rear part. Moreover the baffle plate has a forwardly extending part at its lower edge which forms a settling zone for the paint and paint accumulating around this part is also drawn into the rear part of the tank.

In the rear part some of the paint rises to the surface and can interfere with the flow of air and water into the entrainment ducts, the lower ends of which are necessarily placed close to the water surface.

In accordance with the present invention, in a booth of the type specified the surface baffle is part of a vertically disposed wall which allows communication between the front and rear parts of the tank only through one or more transfer openings in the wall below the water level, a surface-removal device is arranged in front of the or each transfer opening to remove floating paint to a region of the front part of the tank defined by baffle plates which extend above the water level, water in the said region being constrained by the baffle plates to flow to a remote zone of the front part of the tank before it can return to the surface-removal device.

Preferably the or each transfer opening is of small width relative to the width of the water curtain. In a preferred construction a transfer opening is located close to one side wall of the booth and the said remote zone is adjacent the other side wall.

Thus floating paint cannot accumulate in the vicinity of the transfer opening to such a thickness that it will pass through into the rear part of the tank. Moreover the zone from which paint in suspension can reach the rear part is limited to that adjacent the transfer opening and the baffle plates can be arranged to create a circulation in the front part of the tank such that most of the paint has either settled to the bottom or risen to the top before it reaches the transfer opening. In particular the region defined by the baffle plates is preferably disposed to receive the greater part of the water curtain so that much of the paint is first deposited in this region, which is subject to strong agitation by the falling water. The paint is then either retained in this region or if allowed to leave it has a long flow path and is likely to float or sink before it can reach the transfer opening.

The surface-removal device is preferably a venturi device of the kind described in my U.K. Pat. No. 1,309,737 which effects dispersion of the floating paint accompanied by sinkage of its heavier solid constituents. The delivery of the outflow from the venturi device into the region defined by the baffle plates creates further turbulence in this region which aids the breakdown of the paint into sinkable and floating constituents. However, other types of surface-removal device may be used, such as various types of mechanical pump. For example a centrifugal pump such as described in U.S. Pat. No. 2,890,660 (Umbricht) may be suitable.

Figure 2:
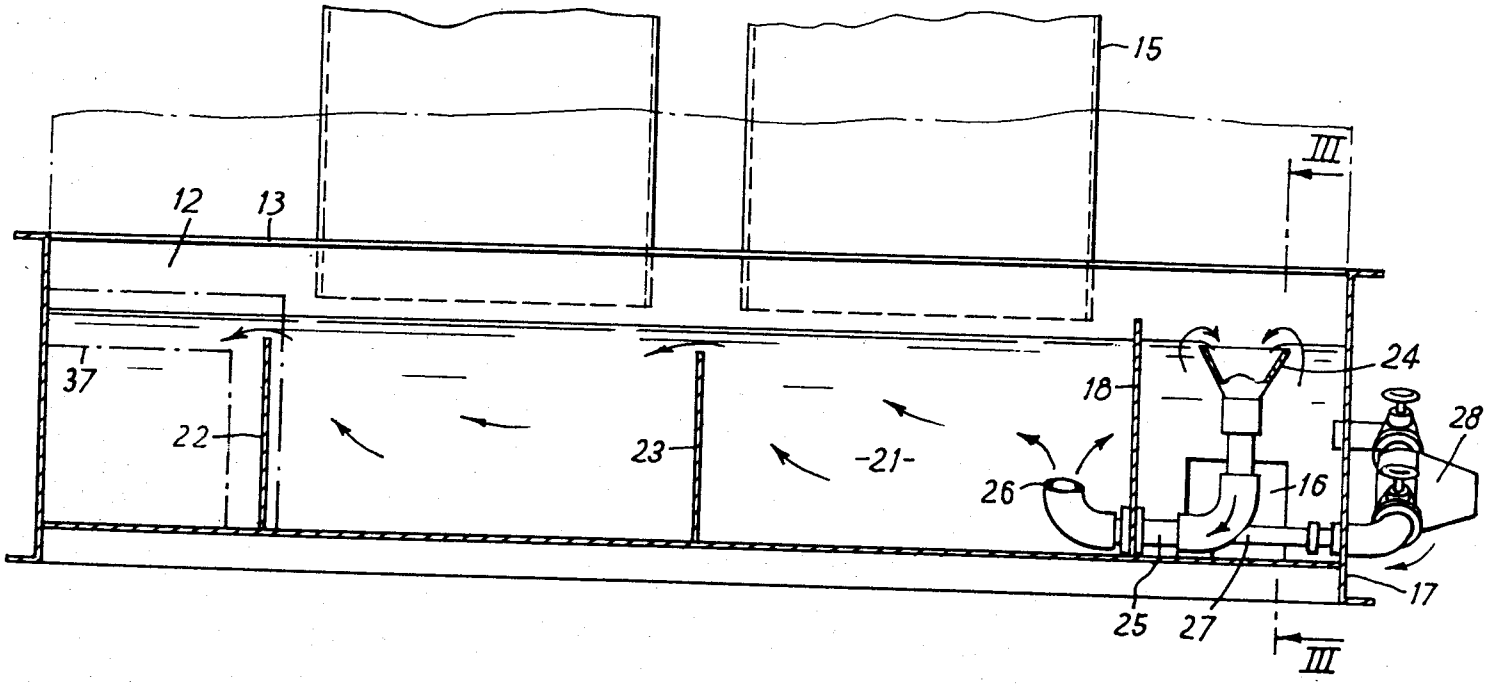
Figure 3:
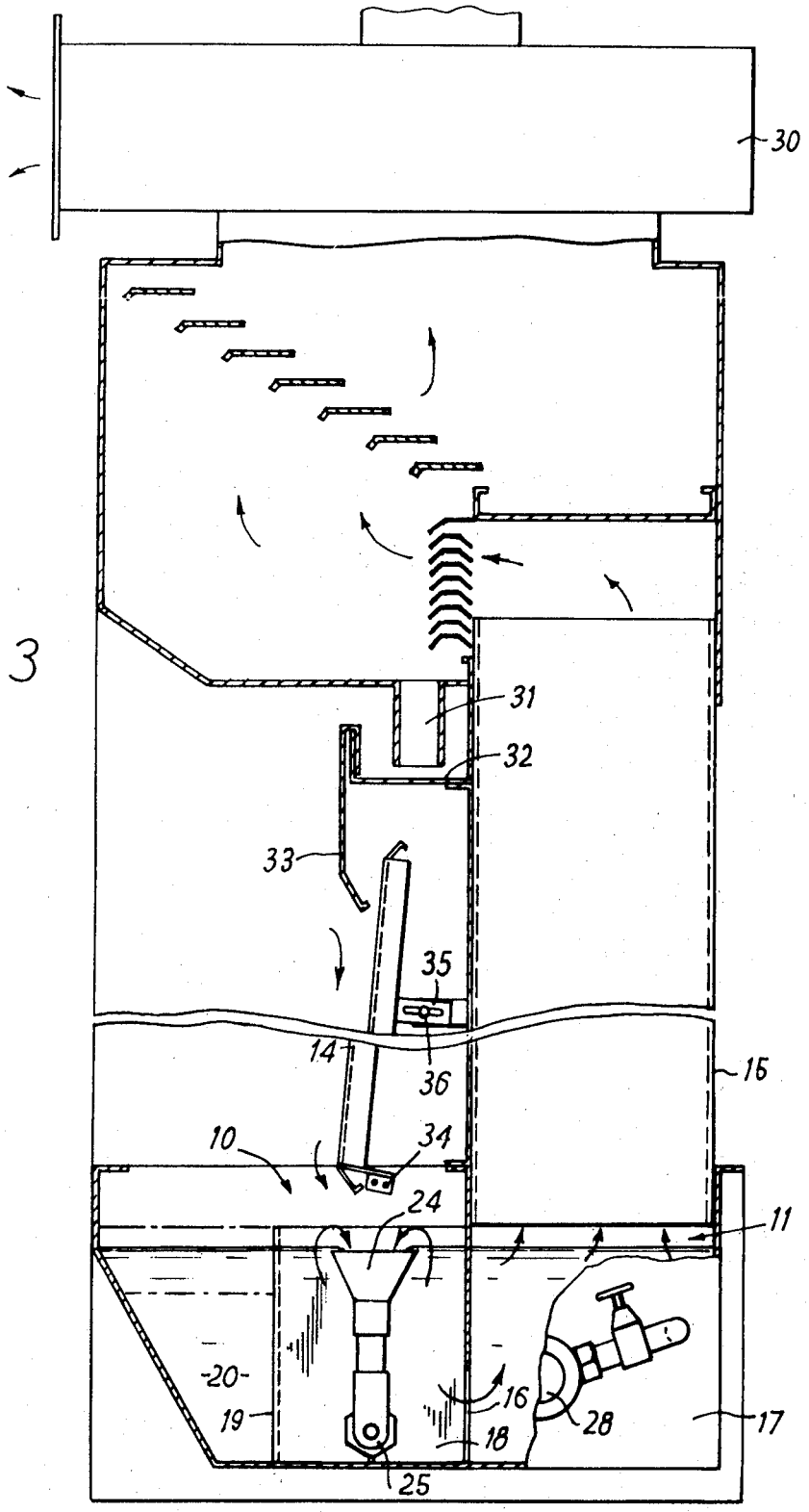

The invention will now be described in more detail with the aid of an example illustrated in the accompanying drawings, in which:

FIG. 1 is a plan view of the tank of a paint spray booth in accordance with the invention, FIG. 2 is a section on the line II—II of FIG. 1, and FIG. 3 is a section on the line III—III of FIG. 2 together with a corresponding section of the upper part of the spray booth.

The water tank shown in the drawings is rectangular in plan with a front part 10 divided from a rear part 11 by a vertical wall 12 which extends for the full height of the tank and has a forwardly extending flange 13 along its upper edge. As seen in FIG. 3, a back plate 14 of the booth, over which in operation a water curtain falls, is arranged above the forward part 10 of the tank. The water for the water curtain is drawn from the rear part 11 of the tank by vertical entrainment ducts 15 through which a flow of air is drawn by an extractor fan 30 in the upper part of the booth. To enable the water forming the curtain to circulate from the front part 10 to the rear part 11 of the tank, the wall 12 has a single transfer opening 16 located adjacent a side wall 17 of the tank and at the bottom of the wall 12, well below the water level. The width of the opening 16 is less than a tenth of the width of the tank.

The front part of the tank has a baffle plate 18 extending forward from the wall 12 parallel to the side wall 17 of the tank and joined to a baffle plate 19 which extends parallel to the wall 12 over the major part of the width of the tank and lies at approximately equal distances from the dividing wall 12 and the front wall of the tank to divide the front part 10 into a forward region 20 and a rearward region 21. The baffle plates 18 and 19 both extend from the bottom of the tank to a height above the water level. At the end remote from the baffle plate 18, the baffle plate 19 is connected to the wall 12 by a barrier wall 22 which extends from the bottom of the tank to a height below the water level. A similar barrier wall 23 parallel to the baffle plate 18 and the wall 22 is located halfway along the baffle plate 19.

In front of the transfer opening 16 and between the wall 17 and the baffle plate 18 is arranged a surface-removal device in the form of a venturi unit. The venturi unit has a collecting chamber 24 of inverted conical form arranged close to the water level to receive floating paint. The chamber 24 communicates by way of a pipe 25 with an outlet 26. The pipe 25 passes through the baffle plate 18 into the region 21 so that the collected paint is delivered by the outlet 26 into the region 21 between the baffle plate 19 and the dividing wall 12. Disposed below the collecting chamber 24 in the pipe 25 is a venturi jet supplied with water under pressure through a pipe 27 by a pump 28 which draws the required water from the rear part 11 of the tank at 29. The operation of the venturi unit is as described in my U.K. Pat. No. 1,309,737.

The water circulation which results from the action of the venturi unit is indicated in the drawings by arrows. The paint removed from the surface in front of the transfer opening 16 is dispersed in the rearward region 21 and the heavier constituents largely fall out in this region and are retained by the barrier walls 22 and 23. This region is subject to continuous agitation by the water curtain falling down the back wall 14 and being drawn back and broken up by the flow of air from the booth below the wall 14 and over the flange 13 into the rear space from which the air is extracted by the ducts 15. Some of the lighter constituents of the paint pass over the barrier walls 22 and 23, aided by the rapid flow of the water along the surface resulting from the presence of the walls 22 and 23, and reach the forward region 20. In the course of passing through this forward region across the full width of the booth the dispersed material largely either sinks to the bottom or floats to the top so that only a very small proportion passes through the opening 16 into the rear part 11 of the tank. The floating material is collected by the venturi unit and recirculated so that there is no accumulation of a floating layer near the opening 16.

Arrows in the drawings also show the air flow created by the extractor fan 30. As seen in FIG. 3 this is positioned at the top of the booth and draws air up through the ducts 15, thus entraining water which is lifted to the top of the booth and there drops out by way of openings 31 into a channel 32 extending across the width of the booth above the back plate 14. The water in the channel 32 overflows down a weir plate 33 of relatively small height and from the lower edge of the weir plate 33 falls onto the back plate 14, which is inclined slightly towards the front of the booth. Thus air is extracted from the booth not only beneath the lower edge of the plate 14 but also over its upper edge through the water curtain falling between the weir plate 33 and the back plate 14. The air passes from the back of the plate 14 over the top edge of the wall 12 and into the lower ends of the ducts 15.

The back plate or flood sheet 14 is swingably mounted about a pivot axis 34 at its lower edge and is adjustably secured to a bracket 35 by a clamping screw 36. Thus the angular position of back plate 14 is adjustable to enable its upper edge to be placed closer to or further away from the weir plate 33, thus varying, or even cutting off completely, the air extraction between the weir plate 33 and the back plate 14. This adjustment of the width of the slot between the weir plate and the back plate, which allows the user to adjust the air extraction in accordance with varying spraying conditions, is of value in any spray booth having dual air extraction, independent of the method by which the water curtain is formed. Thus, for example, a similar adjustable mounting for the back plate could advantageously be included in a paint spray booth in which water from the curtain is pumped up from the tank and the air extraction from below the back plate and through the slot between the back plate and the weir plate is solely for the purpose of removing fine spray from the booth.

An optional surface baffle 37 may be fitted in alignment with the baffle plate 19 to prevent passage of floating debris from the rearward region 21 into the forward region 20.

I claim:

1. In a paint spraying booth having a back wall over which a water curtain flows to collect sprayed paint, a tank to receive the water curtain, vertical entrainment ducts disposed above the rear part of the tank, means for generating a flow of air through said ducts to lift water from the tank for the formation of the water curtain, and a surface baffle dividing the rear part of the tank from the water surface in a front part of the tank into which the curtain falls, the improvement comprising a vertically-disposed wall separating the front and rear parts of the tank and extending from the bottom of the tank to form said surface baffle, one or more transfer openings in said wall below the water level, and baffle plates in the front part of the tank extending above the water level and defining a region adjacent the back wall of the booth to receive the water curtain, said baffle plates preventing direct flow of water from said region to a transfer opening whereby the water is constrained to flow to a remote zone of the front part of the tank before returning to the transfer opening or openings.

2. In a paint spraying booth as claimed in claim 1 a surface removal device arranged in front of the or each transfer opening to remove floating paint, said surface-removal device having an outlet opening into said baffled region for the delivery of the paint to said region.

3. In a paint spraying booth as claimed in claim 2 said surface removal device comprising a venturi unit.

4. In a paint spraying booth as claimed in claim 2 said baffle plates comprising a first plate extending parallel to but forwardly of said separating wall and a second plate joining one end of said first plate to said separating wall near a transfer opening, said outlet of the surface-removal device passing through said second plate, whereby water in the front part of the tank flows between the separating wall and the first plate away from the second plate and thereafter flows in front of said first plate towards the transfer opening.

5. In a paint spraying booth as claimed in claim 4, transverse barrier walls extending between the separating wall and the first plate, said barrier walls rising from the bottom of the tank to a height below the water level.

6. In a paint spraying booth as claimed in claim 1 barrier walls in said baffled region disposed transverse to the direction of waterflow and extending upwards from the bottom of the tank to a level below the water surface, whereby the water flows over said barrier walls while sunken paint is held back.

7. In a paint spraying booth as claimed in claim 1 the improvement wherein said back wall comprises a back plate and a weir plate, said weir plate being disposed above the back plate, an air extraction slot defined between said weir plate and said back plate, said air-flow-generating means communicating with said slot to extract air from the booth through said slot, means swingably mounting said back plate whereby the position of said back plate may be adjusted relative to said weir plate to change the width of the slot, and means for securing the back plate in its adjusted position.

* * * * *